US011623814B2

(12) United States Patent
De Brugiere et al.

(10) Patent No.: US 11,623,814 B2
(45) Date of Patent: Apr. 11, 2023

(54) DISPOSABLE DEFORMABLE CAPSULE CONTAINING A COSMETIC PRODUCT

(71) Applicant: LABORATOIRES M&L, Manosque (FR)

(72) Inventors: Philippe De Brugiere, Marly le Roi (FR); Holger Kloeppel, Ortenberg (DE)

(73) Assignee: LABORATOIRES M&L, Manosque (FR)

( * ) Notice: Subject to any disclaimer, the term of this patent is extended or adjusted under 35 U.S.C. 154(b) by 99 days.

(21) Appl. No.: 17/275,402

(22) PCT Filed: Aug. 14, 2019

(86) PCT No.: PCT/EP2019/071885
§ 371 (c)(1),
(2) Date: Mar. 11, 2021

(87) PCT Pub. No.: WO2020/052898
PCT Pub. Date: Mar. 19, 2020

(65) Prior Publication Data

US 2022/0055820 A1 Feb. 24, 2022

(30) Foreign Application Priority Data

Sep. 14, 2018 (FR) ..... 18 58286

(51) Int. Cl.
*B65D 83/00* (2006.01)
*A45D 34/00* (2006.01)

(52) U.S. Cl.
CPC ..... *B65D 83/0055* (2013.01); *A45D 34/00* (2013.01); *A45D 2034/005* (2013.01); *A45D 2200/054* (2013.01); *A45D 2200/058* (2013.01)

(58) Field of Classification Search
CPC ..... B65D 83/0055; A45D 34/00; A45D 2034/005; A45D 2200/054; A45D 2200/058
See application file for complete search history.

(56) References Cited

U.S. PATENT DOCUMENTS 4,759,472 A 7/1988 Strenger
7,108,440 B1 * 9/2006 Gruenbacher ..... A47L 13/19 401/133

(Continued)

FOREIGN PATENT DOCUMENTS

EP 2 038 189 B1 5/2011
FR 2 673 916 A1 9/1992

(Continued)

OTHER PUBLICATIONS

Machine Translation of FR-3067913-A1.*

(Continued)

*Primary Examiner* — Jeremy Carroll
(74) *Attorney, Agent, or Firm* — Nixon & Vanderhye

(57) ABSTRACT

A disposable deformable capsule includes: a pouch containing a cosmetic product whose periphery is two sheets pressed against and fixed to one another; a channel connecting the pouch to the outside, forming a section of narrower cross-sectional area; a frangible wall separating the pouch and channel, shapes as an inward-pointing angular recess within the otherwise convex shape of the periphery of the pouch, the rupture of which occurs by peeling apart, at the recess, the two sheets, placing the pouch in communication with the channel so the product flows to the channel; a connector, able to be coupled with another connector of another capsule, with rigidity sufficient to seal the connection between the capsules once coupled, located at one end of the channel opposite the end next to pouch or at an (Continued)

opening distinct from the end of the channel located next to pouch, opening to outside the capsule.

20 Claims, 4 Drawing Sheets

(56) References Cited

U.S. PATENT DOCUMENTS

| | | | | |
|---|---|---|---|---|
| 2016/0113377 | A1 | 4/2016 | Moussion et al. | |
| 2020/0129941 | A1 * | 4/2020 | Bachellier | B01F 31/55 |
| 2020/0146423 | A1 | 5/2020 | De Brugiere | |
| 2020/0163434 | A1 | 5/2020 | De Brugiere et al. | |
| 2020/0178670 | A1 * | 6/2020 | Bachellier | A45D 34/00 |

FOREIGN PATENT DOCUMENTS

| | | | | |
|---|---|---|---|---|
| FR | 2 894 942 | A1 | 6/2007 | |
| FR | 3 067 917 | | 12/2018 | |
| FR | 3067913 | A1 * | 12/2018 | B01F 11/0065 |
| FR | 3067912 | B1 * | 7/2019 | A45D 34/00 |
| FR | 3 067 915 | B1 | 7/2021 | |
| WO | 2004/069731 | | 8/2004 | |
| WO | 2014/083279 | | 6/2014 | |
| WO | 2016/102816 | | 6/2016 | |
| WO | 2017/204257 | A1 | 11/2017 | |
| WO | 2018/234715 | | 12/2018 | |
| WO | 2018/234716 | | 12/2018 | |
| WO | 2018/234717 | | 12/2018 | |

OTHER PUBLICATIONS

Machine Translation of FR-3067912-B1.*

International Search Report for PCT/EP2019/071885, dated Nov. 5, 2019, 4 pages.

Written Opinion of the ISA for PCT/EP2019/071885, dated Nov. 5, 2019, 7 pages.

Search Report for FR1858286, dated May 27, 2019, 10 pages.

Office Action issued in Korean Patent Application No. 10-2021-7007615 dated Jan. 5, 2023.

* cited by examiner

DISPOSABLE DEFORMABLE CAPSULE CONTAINING A COSMETIC PRODUCT

This application is the U.S. national phase of International Application No. PCT/EP2019/071885 filed 14 Aug. 2019, which designated the U.S. and claims priority to FR Patent Application No. 18 58286 filed 14 Sep. 2018, the entire contents of each of which are hereby incorporated by reference.

FIELD OF THE INVENTION

The invention relates to the field of disposable deformable capsules comprising a cosmetic product, in particular a cosmetic product intended to be added to a mixture of cosmetic products to yield a cosmetic product ready for use for its user.

BACKGROUND OF THE INVENTION

According to a first prior art, for example presented in European patent EP 2038189, there is a known system for producing a personalized cosmetic product from pre-dosed pods containing different base products, these pods being opened and their contents mixed with water in a machine.

The opening of the pods is not calibrated for a fairly limited force, so is not completely controlled in cases of reduced force, and their subsequent pouring is not guided by a channel at the pod exit, but this is not a disadvantage in the context of patent EP 2038189 since their contents are scattered in a mixing chamber where water is also mixed with the cosmetic product coming from the pod.

According to a second prior art, for example described in U.S. Pat. No. 4,759,472 or in patent application FR2673916 or in patent application WO2017/204257, a capsule is known that comprises a pouch of cosmetic product closed by a frangible wall having an inward-pointing angular recess which when opened causes the cosmetic product to exit the pouch and even exit the capsule, the cosmetic product then being directly ready for use and not involved in the production of a mixture.

However, although opening the capsule is more finely calibrated in cases of reduced force, once the frangible wall is broken, in other words opened, the cosmetic product flows out of the capsule in a poorly controlled or even completely uncontrolled manner.

SUMMARY OF THE INVENTION

The aim of the present invention is to provide a deformable capsule that at least partially overcomes the aforementioned disadvantages.

More particularly, the invention aims to provide a deformable capsule which allows good control over the opening of the capsule when pressure is exerted on the deformable capsule beyond a given opening threshold, as well as properly guiding the flow of the deformable capsule contents out of the deformable capsule after it is opened.

Indeed, the invention has detected a two-fold problem encountered by disposable deformable capsules having a frangible wall. On the one hand, the opening is poorly controlled during the opening of the capsule, resulting in either an inadvertent tear causing the contents to spurt out of the pouch in an uncontrolled direction and intensity or occasionally no tear at all which prevents the opening of the capsule and the flow of its contents from the pouch. On the other hand, once the contents have flowed out of the pouch, their outward path is also not controlled, causing a spontaneous spurt of the contents out of the capsule which are then not guided.

The invention aims to solve this two-fold problem, at least in part. On the one hand, the opening will be better controlled during the opening of the capsule, due to the presence of a concave angular shape, also called an inward-pointing angular recess, in the frangible wall, and due to the separation of the two sheets forming the frangible wall, by peeling. On the other hand, once the contents have flowed out of the pouch, their outward path will be better controlled due to the presence of both a guide channel forming a section of narrower cross-sectional area and a connector located at the end of the guide channel enabling the coupling of the capsule to another capsule in order to mix together the contents of the two capsules to create the final cosmetic product that is ready to use, the movement of the mixture between the two respective pouches of the two capsules via a channel of narrower cross-sectional area between the pouches, including the two connectors, also achieving a better homogenization of this mixture, this movement being advantageously carried out one or more times, alternately in one direction and then the other, preferably inside a machine that alternately presses on one and then the other of these two deformable capsules.

Thus, when two deformable capsules are joined together, the contents of one of them can first flow into the other one, and then the mixture can travel from one capsule to another in order to be better homogenized while remaining inside the pair of capsules, without exiting to a mixing chamber which would soil the mixing machine. This pair of interconnected capsules can be used in a machine for manufacturing a cosmetic product such as the one described for example in patent application FR1755749, incorporated herein by reference.

Patent application FR1755749 describes a system for manufacturing a personalized cosmetic product from pre-dosed packaging units, also called pods, the mixing of the contents of the pre-dosed packaging units being done automatically by a machine, the end consumer of the personalized cosmetic product only needing to introduce the pre-dosed packaging units into the machine and to collect the ready-to-use personalized cosmetic product. The mixing is done inside the pair of interconnected capsules without touching the rest of the mixing machine, therefore without soiling it.

The particular internal structure of the disposable deformable capsule of patent application FR1755749 can be further improved so as to better control the opening of these deformable capsules, so that they open whenever such opening is required and so that they also do not open unexpectedly during impacts or mishandling.

To this end, the present invention proposes a disposable deformable capsule comprising: a pouch containing a cosmetic product, of which the periphery is formed by two sheets pressed against and fixed to one another; a channel connecting the pouch to the outside of the capsule, forming a section of narrower cross-sectional area relative to the pouch; a frangible wall separating the pouch from the channel, having the shape of an inward-pointing angular recess within the otherwise convex shape of the periphery of the pouch, of which the rupture, caused by pressure exerted on the pouch, is carried out by the peeling apart, at this inward-pointing angular recess, of these two sheets pressed against and fixed to one another, places the pouch in communication with the channel such that the cosmetic product flows from the pouch to the channel; a male or female connector, intended to couple with a connector, female or male, of another capsule, sufficiently rigid to ensure a sealed connection between the capsules once the connectors are coupled to each other, located at one end of the channel opposite an end of the channel located next to the pouch or located at a channel opening that is distinct from the end of the channel located next to the pouch, opening to outside the capsule.

According to preferred embodiments, the invention comprises one or more of the following features which may be used separately or in any combination.

Preferably, the channel is a guide channel forming a narrowing of constant or nearly constant cross-sectional area within plus or minus 20%, preferably within plus or minus 10%, for all or part of its length, relative to the pouch, this narrowing of constant or nearly constant cross-sectional area having a length at least 3 times greater than its largest width, preferably at least 7 times greater than its largest width, the largest width of this narrowing of constant or nearly constant cross-sectional area being at least 4 times smaller than the largest width of the pouch, preferably at least 8 times smaller than the largest width of the pouch.

The shape and the dimensions of the guide channel allow better control of the circulation of the mixture between the pouches of the capsules as well as better homogenization of this mixture as it is guided into the guide channel and as it passes through this guide channel, such passage advantageously occurring one or more times, in one direction and then in the other.

Preferably, the periphery of the pouch is formed by two sheets welded to one another.

The presence of a weld between the two sheets thus allows keeping the contents of the capsule pouch well insulated from the external environment for a longer time and in a more secure manner, reducing or even preventing both leaks and accidental tears.

Preferably, the disposable deformable capsule also comprises two welds: a first weld extending all around the pouch while enclosing most of the channel, and a second weld extending all around the pouch without enclosing most of the channel, the second weld being at least partly, preferably completely, arranged inside the first weld, the second weld being more fragile than the first weld, the inward-pointing angular recess being established by the second weld only and not by the first weld.

Thus, when opening the capsule, during the opening of the frangible wall, the direction of flow of the pouch contents to outside the pouch is better controlled and is directed towards the guide channel, so that it then flows towards the other capsule to which this capsule has been connected.

Preferably, the second weld is more fragile than the first weld, the threshold for the pressure that will open the second weld being between 20% and 50%, preferably between 30% and 40%, of the threshold for the pressure causing the rupture of the first weld.

Thus, when opening the capsule, during the opening of the frangible wall, the direction of flow of the pouch contents to outside the pouch is even better controlled, and is better guided towards the guide channel, so that it then flows towards the other capsule to which this capsule has been connected. In this manner, it is easy to calibrate a pressure that will almost always open the second weld while almost never tearing the first weld.

Preferably, as the rupture of the frangible wall occurs by the peeling apart, at this inward-pointing angular recess, of these two sheets welded to one another, this weld is created by fusing only the two outermost layers of the two sheets.

The peeling apart is thus achieved more easily, further reducing the risk of inadvertent tearing which can cause the pouch contents to spurt completely out of the capsule without passing through the channel, thereby causing a partial loss of these contents, and improving the tidiness and cleanliness of the opening of this frangible wall.

Specific structures for the weld created between the faces of the pouch are particularly suitable. They are given below.

Preferably, the weld has: a welding temperature comprised between 160° C. and 200° C., advantageously between 170° C. and 190° C., and/or a welding pressure comprised between 2 bar and 6 bar, advantageously between 3 bar and 5 bar, and/or a welding time comprised between 0.5 s and 3 s, advantageously between 1 s and 2 s. This concerns the weaker or more fragile weld when there are two different welds.

Preferably, the shape of the pouch of the capsule, in its mid-plane perpendicular to the direction of its thickness, is circular.

This circular shape thus ensures better concentration of the pressure exerted to open the capsule, towards the inward-pointing angular recess, thereby enabling the opening of the capsule to be better controlled, due to the balanced distribution of forces on the circumference of a circular shape.

Preferably, the pouch is flattened, one of its two faces being flat, the other of its two faces being at least partly convex and flexible so as to allow expulsion of the contents of the pouch by mechanical pressure on it.

The simplicity of using the capsule is thus improved. On the one hand, the flat face of the pouch allows simple and homogeneous heating, even preferably with a single heating element of simple structure of advantageously constant thickness, when two capsules are arranged facing one another. On the other hand, the convex and flexible face of the pouch provides a simple manner of completely expelling the contents of the pouch out of the pouch, by simple mechanical pressure, and even preferably with two mechanical members, for example pistons, arranged facing one another when two capsules are arranged facing one another, each mechanical member being responsible in turn for exerting pressure on one of the capsules to empty its contents towards the other capsule and then vice versa.

Preferably, the convex shape also comprises a re-entrant portion into which the inward-pointing angular recess advances.

Thus, when opening the capsule, during the opening of the frangible wall, the direction of flow of the pouch contents to outside the pouch is better controlled and is directed towards the guide channel, so that it then flows towards the other capsule to which this capsule has been connected.

Specific structures for the faces of the pouch are particularly suitable. They are given below.

Preferably, the convex face is a thermoformed film, more preferably monolayer, even more preferably polyolefin, advantageously of a thickness comprised between 100 μm and 300 μm, more advantageously of a thickness comprised between 150 μm and 250 μm.

The thickness of the convex face is for example 200 μm.

Preferably, the flat face is a flat and flexible film, more preferably multilayer, even more preferably formed by a stack of PET/aluminum/PP, advantageously of a thickness comprised between 50 μm and 250 μm, more advantageously of a thickness comprised between 100 μm and 200 μm.

The thickness of the flat face is, for example, 150 μm.

The thickness of the flat face is preferably less than the thickness of the convex face.

Preferably, the pouch contains a predetermined amount of only one of the two phases, the mixture thereof forming a ready-to-use cosmetic product.

Thus, until the moment of use by mixing the two phases, each phase contained in one of the two capsules can remain completely isolated from the other phase contained in the other capsule, allowing completely or almost completely doing without preservatives in the composition of the phases, each of these phases then being natural, in other words without preservatives or almost without preservatives.

Specific structures for the faces of the pouch are particularly suitable. They are given below.

Preferably, the inward-pointing angular recess has a depth which is greater than half the width of this angular recess and less than the width of this angular recess.

A good compromise thus is achieved between controlling the opening of the frangible wall and a minimum threshold required for opening this frangible wall, reducing or even eliminating the risk of accidentally opening this frangible wall.

Preferably, in a first embodiment, for certain materials of the sheets pressed onto one another which are more strongly fixed to one another, resulting in a frangible weld that is intrinsically slightly stronger, the width of the frangible wall of the inward-pointing angular recess is constant along the entire length of the frangible wall of the inward-pointing angular recess.

Thus, the manufacture of the inward-pointing angular recess is simplified and the reproducibility of the properties of this inward-pointing angular recess is better guaranteed, the other characteristics of the frangible wall, or where appropriate of the weld, of this inward-pointing angular recess (thickness, width, and depth, as well as shape) being sufficient to guarantee that the frangible wall, or where appropriate the weld, begins to open at the proper location at the most advanced portion of the inward-pointing angular recess relative to its arms, without requiring additional complexity consisting of refining the width of the frangible wall, or where appropriate the weld, the inward-pointing angular recess at its most advanced portion relative to its arms attaching it to the periphery of the capsule. We thus obtain a clean and complete opening of the entire inward-pointing angular recess, including when this opening is caused by exertion of a calibrated force, for example from the pressure of a machine piston on the deformable capsule, while in the case of a variable width of the frangible wall of the inward-pointing angular recess, there is a chance of only partially opening and of variations from one opening to the next.

Preferably, in a second embodiment, for certain other materials of the sheets pressed against one another which are less strongly fixed to one another, resulting to a frangible weld that is intrinsically a little less solid, the width of the frangible wall of the inward-pointing angular recess is greater at the most advanced portion of the inward-pointing angular recess than at the arms of the inward-pointing angular recess.

Reproducibility of the properties of this inward-pointing angular recess is thus better guaranteed, the variable width of the frangible wall of the inward-pointing angular recess decreasing from the most advanced portion towards the arms, helping to better guarantee that the frangible wall, or where appropriate the weld, begins to open at the proper location at the most advanced portion of the inward-pointing angular recess. Thus, even in this case, a clean and complete opening of the entire inward-pointing angular recess is obtained, including when this opening is caused by exertion of a calibrated force, for example from the pressure of a machine piston on the deformable capsule.

Preferably, the width of the frangible wall of the inward-pointing angular recess is between 1 mm and 2.5 mm, preferably between 1.5 mm and 2 mm.

Preferably, the inward-pointing angular recess has a pointed shape with the point towards the interior, preferably a V shape, more preferably a V shape whose angle at the point is an acute angle.

The opening pressure exerted on the deformable capsule is thus more localized at the point of the inward-pointing angular recess, if this point is narrower.

Preferably, the frangible wall is dimensioned in its thickness, width, length, and shape so that it opens when the pressure exerted on the pouch corresponds to a force comprised between 10 N and 45 N, preferably between 15 N and 40 N (N=Newton).

Other features and advantages of the invention will be apparent from reading the following description of a preferred embodiment of the invention, given as an example and with reference to the accompanying drawings.

DETAILED DESCRIPTION OF THE INVENTION

Figure 1:
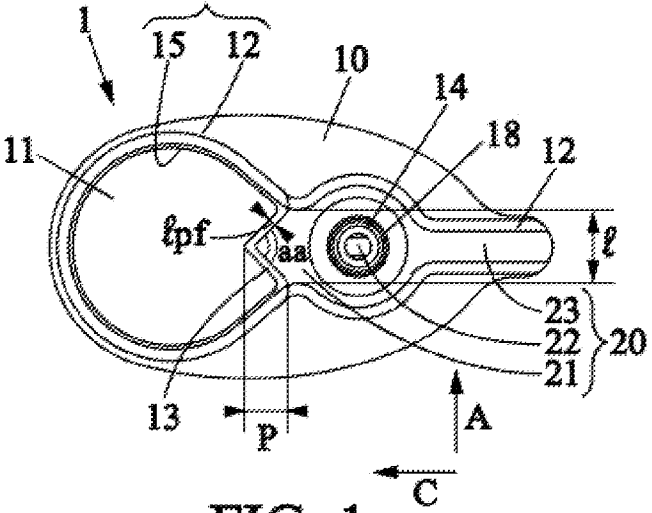
FIG. 1 schematically represents a top view of an example of a deformable capsule with a female connector according to an embodiment of the invention.

FIG. 1 schematically represents a top view of an example of a deformable capsule with a female connector according to an embodiment of the invention.

Figure 2:
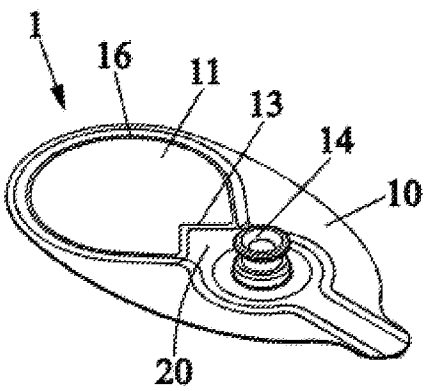
FIG. 2 schematically represents a perspective view of an example of a deformable capsule with a female connector according to an embodiment of the invention already represented in FIG. 1.

FIG. 2 schematically represents a perspective view of an example of a deformable capsule with a female connector according to an embodiment of the invention already represented in FIG. 1.

Figure 3:
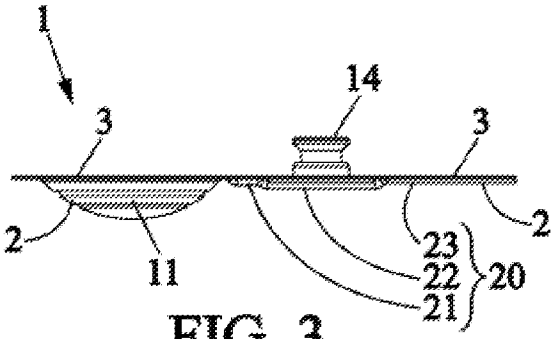
FIG. 3 schematically represents a side view, in a first direction A, of an example of a deformable capsule with a female connector according to an embodiment of the invention already represented in FIG. 1.

FIG. 3 schematically represents a side view, in a first direction A, of an example of a deformable capsule with a female connector according to an embodiment of the invention already represented in FIG. 1.

Figure 4:
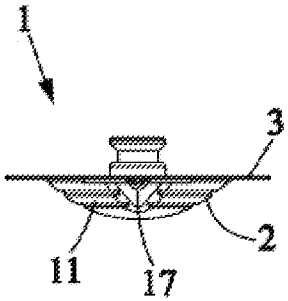
FIG. 4 schematically represents a side view, in a second direction C, of an example of a deformable capsule with a male connector according to an embodiment of the invention already represented in FIG. 1.

FIG. 4 schematically represents a side view, in a second direction C, of an example of a deformable capsule with a male connector according to an embodiment of the invention already represented in FIG. 1.

A deformable capsule 1 comprises a pouch 11 extended by a channel 20 which itself is extended by a female connector 14 extending orthogonally to the mid-plane 10 of the capsule 1 which is substantially generally flat.

The capsule 1 is formed by the superposition of two sheets 2 and 3 pressed against one another, attached to one another, preferably welded to one another along weld areas. These two sheets 2 and 3 trap between them the base 18 of a female connector 14 or more precisely of a female connector end piece 14, intended to receive the interlocking portion of a male connector 44 of another capsule 4 represented in FIGS. 5 to 8. Sheet 2 is a thermoformed shell while sheet 3 is a flat film which covers the thermoformed shell in a plane 10 in order to close it.

The capsule 1 comprises a pouch 11 filled with a cosmetic product intended to be mixed with another cosmetic product of another pouch 41 of another capsule 4 represented in FIGS. 5 to 8, the mixture of these two cosmetic products, once homogenized, yielding the final cosmetic product ready to be used by the user, for example a cream to apply to the face. One of the cosmetic products to be mixed is the base, for example a fatty phase, while the other cosmetic product is a complex of active ingredients, for example an aqueous phase. Here capsule 1 contains the base and has a larger capacity than capsule 4 which contains the complex of active ingredients. The volume of pouch 11 is for example about 1 ml, and can expand by elastic deformation to 1.2 ml or even slightly more.

The channel 20 comprises three portions, two portions going from pouch 11 to the female connector 14 which are the inner portion 21 then the central portion 22 opening on one side into the inlet of the female connector 14 and on the other side into the third portion, the outer portion 23, leading directly to the outside of the capsule 1, which is the outlet to which the mixture is expelled once homogenized. The outlet of the outer portion 23 remains closed for the duration of the back-and-forth movements of the mixture between capsules 1 and 4: it will not be opened until homogenization of the mixture has ended. During homogenization of the mixture, when pressure is exerted on pouch 11 of capsule 1, its contents are emptied so as to first enter the inner portion 21 of the channel 20, then into the central portion 22 of the channel 20, before entering the female connector 14 to travel towards the male connector 44 of the other capsule 4, the outlet of the outer portion 23 of the channel 20 remaining closed, either by a seal or by the clamping of a member of the machine into which the pair of capsules 1 and 4 have been inserted. After homogenization of the mixture, when pressure is exerted simultaneously on pouch 11 of capsule 1 and on pouch 41 of capsule 4, once the outlet of the outer portion 23 of the channel 20 is opened, either by opening its seal or by releasing the clamping, the contents of pouch 11 are emptied, first into the inner portion 21 of the channel 20 then into the central portion 22 of the channel 20, before entering the female connector 14 to travel towards the male connector 44 of the other capsule 4.

The assembly of pouch 11 and channel 20 is surrounded by an outer weld 12 which first extends around almost the entire periphery 16 of the pouch 11, then encloses the channel 20 as well as the base 18 of the female connector 14.

The pouch 11 is also surrounded by an inner weld 15 extending around the entire periphery 16 of the pouch 11, first following the outer weld 12, then closing this periphery 16 by an inward-pointing angular recess 13 which forms a re-entrant angle in this convex and substantially circular periphery 16 of the pouch 11, this inward-pointing angular recess 13 having a re-entrant V-shape and being separated from the outer weld 12. This inner weld 15 does not enclose the channel 20 at all. This inward-pointing angular recess 13 is facing a concavity 17 of the pouch 11 enabling it to penetrate more deeply inwards and towards the center of the pouch 11.

The inward-pointing angular recess 13 thus has a concavity in the periphery 16 of the otherwise convex pouch 11. The inward-pointing angular recess 13 has a re-entrant V shape, but could also have a rounded tip tending more towards a U shape. The inward-pointing angular recess 13 has an acute angle aa at its point, a depth p between the point and a line connecting the ends of its arms, and a width l from the end of one arm to the end of the other arm. The depth p is advantageously comprised between half and all of the width l.

When pressure is exerted on the central portion of the pouch 11, for example using a machine piston whose travel is orthogonal to the plane of FIG. 1 and vertically upwards within the plane of FIG. 3, force is exerted in particular at the point of the V of the inward-pointing angular recess 13, the two sheets 2 and 3 then moving apart at this point of the V and then continuing to move apart along the arms of the V until the ends of these arms of the V are reached, at the outer weld 12.

Only the inward-pointing angular recess 13 of the inner weld 15 forms the frangible wall which when ruptured releases the contents of the pouch 11 to then empty into the channel 20 in the direction of the female connector 14. The advantageously constant width lpf of the inner weld 15 along the inward-pointing angular recess 13 allows a cleaner and more clear opening of this frangible wall 13, in fact of this frangible weld 13. The rupture of this frangible wall 13, of this frangible weld 13, occurs gently by peeling apart the sheets 2 and 3 which were welded only by their outermost layers facing one another, these two sheets 2 and 3 thus moving away from each other without tearing or opening to the outside of the capsule 1. The peeling is such that two sheets, attached by their outermost layers only, detach from each other and move away from each other without tearing and without opening to the outside. The cosmetic product, which is pressing against the frangible wall 13, moves the two sheets apart from each other by peeling, and advances in the channel 20 while remaining confined in capsule 1, before reaching capsule 4.

Figure 5:
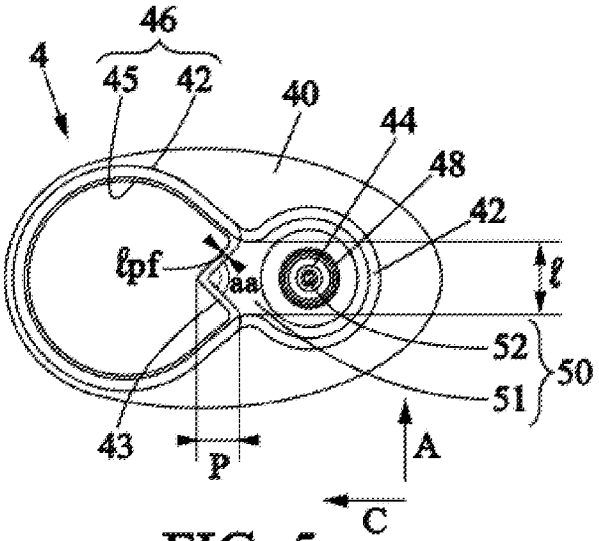
FIG. 5 schematically represents a top view of an example of a deformable capsule with a male connector according to an embodiment of the invention.

FIG. 5 schematically represents a top view of an example of a deformable capsule with a male connector according to an embodiment of the invention.

Figure 6:
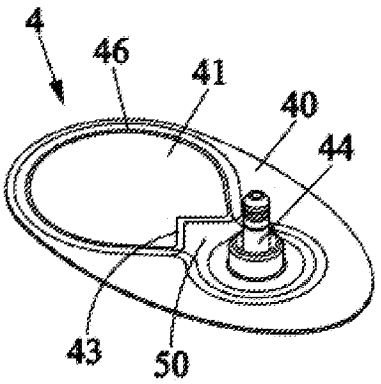
FIG. 6 schematically represents a perspective view of an example of a deformable capsule with a male connector according to an embodiment of the invention already represented in FIG. 5.

FIG. 6 schematically represents a perspective view of an example of a deformable capsule with a male connector according to an embodiment of the invention already represented in FIG. 5.

Figure 7:
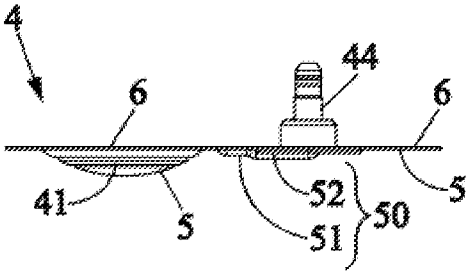
FIG. 7 schematically represents a side view, in a first direction A, of an example of a deformable capsule with a male connector according to an embodiment of the invention already represented in FIG. 5.

FIG. 7 schematically represents a side view, in a first direction A, of an example of a deformable capsule with a male connector according to an embodiment of the invention already represented in FIG. 5.

Figure 8:
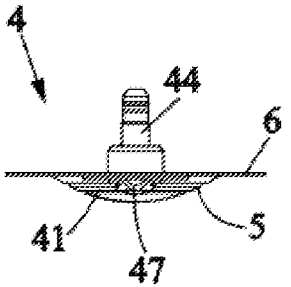
FIG. 8 schematically represents a side view, in a second direction C, of an example of a deformable capsule with a male connector according to an embodiment of the invention already represented in FIG. 5.

FIG. 8 schematically represents a side view, in a second direction C, of an example of a deformable capsule with a male connector according to an embodiment of the invention already represented in FIG. 5.

A deformable capsule 4 comprises a pouch 41 extended by a channel 50 which itself is extended by a male connector 44 extending orthogonally to the mid-plane 40 of the capsule 4 which is substantially generally flat.

The capsule 4 is formed by the superposition of two sheets 5 and 6 pressed against one another, attached to one another, preferably welded to one another along weld areas. These two sheets 5 and 6 trap between them the base 48 of a male connector 44 or more precisely of a male connector end piece 44, intended to fit into a female connector 14 of another capsule 1 represented in FIGS. 1 to 4. Sheet 5 is a thermoformed shell while sheet 6 is a flat film which covers the thermoformed shell in a plane 40 in order to close it.

The capsule 4 comprises a pouch 41 filled with a cosmetic product intended to be mixed with another cosmetic product of another pouch 11 of another capsule 1 represented in FIGS. 1 to 4, the mixture of these two cosmetic products, once homogenized, yielding the final cosmetic product ready to be used by the user, for example a cream to apply to the face. This homogenization occurs by the movement, one or more times, of the mixture of the two cosmetic products initially contained respectively in pouches 11 and 41 of capsules 1 and 4, through the channels 20 and 50 and the female 14 and male 44 connectors, the assembly formed by the channels 20 and 50 and by the female 14 and male 44 connectors forming a section of narrower cross-sectional area relative to the cross-sectional areas of the pouches 11 and 41, thus shearing this mixture, contributing greatly to better and faster homogenization. One of the cosmetic products to be blended is the base, for example a fatty phase, while the other cosmetic product is a complex of active ingredients, for example an aqueous phase. Here capsule 4 contains the complex of active ingredients and has a smaller capacity than capsule 1 which contains the base. The volume of pouch 41 is for example about 0.5 ml, and can expand by elastic deformation to 0.7 ml or even slightly more.

The channel 50 comprises two portions going from pouch 41 to the male connector 44, which are first the inner portion 51 then the central portion 52 opening into the inlet of the male connector 44. The outlet of the outer portion 23 of channel 20 of the other capsule 1 remains closed for the duration of the back-and-forth movements of the mixture between capsules 1 and 4: it will not be opened until homogenization of the mixture has ended. During homogenization of the mixture, when pressure is exerted on pouch 41 of capsule 4, its contents are emptied so as to first enter the inner portion 51 of channel 50, then into the central portion 52 of channel 50 before entering the male connector 44 through an opening of the central portion 52 to travel towards the female connector 14 of the other capsule 1, the outlet of the outer portion 23 of channel 20 of capsule 1 remaining closed, either by a seal or by the clamping of a member of the machine into which the pair of capsules 1 and 4 have been introduced. After homogenization of the mixture, when pressure is exerted simultaneously on pouch 11 of capsule 1 and on pouch 41 of capsule 4, once the outlet of the outer portion 23 of channel 20 of capsule 1 is opened, either by opening its seal or by releasing its clamp, the contents of pouch 41 are emptied, first into the inner portion 51 of channel 50 then into the central portion 52 of channel 50 before entering the male connector 44 to travel towards the female connector 14 of the other capsule 1.

The assembly of pouch 41 and channel 50 is surrounded by an outer weld 42 which first extends around almost the entire periphery 46 of the pouch 41, then encloses the channel 50 as well as the base 48 of the male connector 44.

The pouch 41 is also surrounded by an inner weld 45 extending around the entire periphery 46 of the pouch 41, first following the outer weld 42, then closing this periphery 46 by an inward-pointing angular recess 43 which forms a re-entrant angle in this convex and substantially circular periphery 46 of the pouch 41, this inward-pointing angular recess 43 having a re-entrant V-shape and being separated from the outer weld 42. This inner weld 45 does not enclose the channel 50 at all. This inward-pointing angular recess 43 is facing a concavity 47 of the pouch 41 enabling it to penetrate more deeply inwards and towards the center of the pouch 41.

The inward-pointing angular recess 43 thus has a concavity in the periphery 46 of the otherwise convex pouch 41. The inward-pointing angular recess 43 has a re-entrant V shape, but could also have a rounded tip tending more towards a U shape. The inward-pointing angular recess 43 has an acute angle aa at its point, a depth p between the point and a line connecting the ends of its arms, a width l from the end of one arm to the end of the other arm. The depth p is advantageously comprised between half and all of the width l.

When pressure is exerted on the central portion of the pouch 41, for example using a machine piston whose travel is orthogonal to the plane of FIG. 5 and vertically upwards within the plane of FIG. 7, force is exerted in particular at the point of the V of the inward-pointing angular recess 43, the two sheets 5 and 6 then moving apart at this point of the V and then continuing to move apart along the arms of the V until the ends of these arms of the V are reached, at the outer weld 42.

Only the inward-pointing angular recess 43 of the inner weld 45 forms the frangible wall which when ruptured releases the contents of the pouch 41 to then empty into the channel 50 in the direction of the male connector 44. The advantageously constant width lpf of the inner weld 45 along the inward-pointing angular recess 43 allows a cleaner and more clear opening of this frangible wall 43, in fact of this frangible weld 43. The rupture of this frangible wall 43, of this frangible weld 43, occurs gently by peeling apart the sheets 5 and 6 which were welded only by their outermost layers facing one another, these two sheets 5 and 6 thus moving away from each other without tearing or opening to the outside of the capsule 4. The cosmetic product, which is pressing against the frangible wall 43, moves the two sheets apart from each other by peeling, and advances in the channel 50 while remaining confined within capsule 4, before entering capsule 1.

The various values of the dimensions (widths, lengths, heights, diameters) given in the plans of FIGS. 9, 10, 11 and 12, make it possible to provide a detailed example of the structure of the capsules 1 and 4. All these values are given in mm. FIGS. 9 to 12 are all to scale and all use the same scale.

The mixing machine enables the association of two doses consisting of two flexible deformable capsules 1 and 4 each containing a cosmetic liquid product and each provided with male 44 and female 14 connectors, preferably of plastic. The two capsules 1 and 4 will be connected together so that they can then alternate in receiving the mixture of the two cosmetic liquid products until a homogeneous mixture is formed, for example an emulsion. In fact, the two capsules 1 and 4 connected in this manner form a mixer that is intrinsically sealed to the outside, before the outer portion 23 of the channel 20 is opened to the outside in order to expel the final cosmetic product ready to be used by the user.

The capsules 1 and 4 are placed in a mechanical mixer, and the missing of the initial contents of their respective pouches 11 and 41 will occur by means of two movable pistons that are actuated in an alternating manner and thus alternate in pressing on each of the capsules 1 and 4, which forces the transfer of the mixture from the pouch 11 of capsule 1 to the other pouch 41 of capsule 4, and vice versa.

The flexible and deformable nature of the capsules 1 and 4 makes it easy for one of these capsules 1 and 4 to be flattened to a virtually zero volume by the pistons and the other of these capsules 1 and 4 to expand by the release of the opposite piston in order to absorb the entire volume of the two capsules 1 and 4 in the capsule opposite the flattened one. This alternating action between the capsules 1 and 4 is carried out cyclically.

The liquids of the cosmetic products contained in the pouches 11 and 41 of the capsules 1 and 4 are advantageously heated to a temperature of approximately 85° C., films 2 and 3 as well as films 5 and 6 are also selected to be able to withstand this increase in temperature as well as the pressure applied by the pistons of the mixing machine, without impacting the homogenization time, these capsules 1 and 4 being disposable.

All dimensions in FIGS. 9 to 12 are indicated in mm (mm=millimeter).

Figure 9:
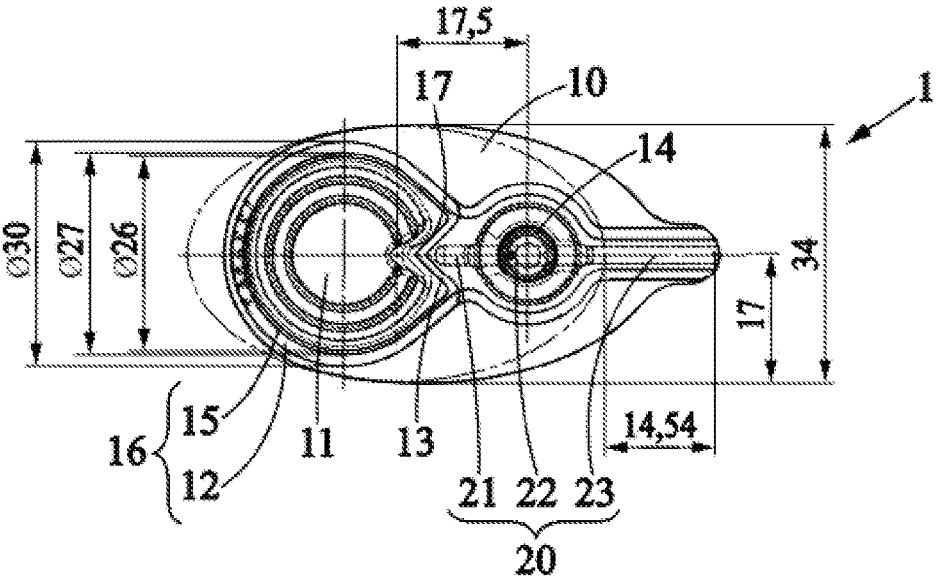
FIG. 9 represents a more precise bottom view of an example of a deformable capsule with a female connector according to an embodiment of the invention.

FIG. 9 represents a more precise bottom view of an example of a deformable capsule with a female connector according to an embodiment of the invention.

The structure of the thermoformed shell of the pouch 11 is created in a multilevel and concentric manner. The inner portion 21 of the channel 20 penetrates pronouncedly into the V formed by the inward-pointing angular recess 13. The inward-pointing angular recess 13 penetrates the concavity 17 of the pouch 11. The channel 20 maintains a constant width and cross-sectional area along its three parts: successively along its inner portion 21, its central portion 22, and its outer portion 23.

These weak-welded inward-pointing angular recesses 13 and 43, whether V-shaped or arcuate, provide better control of the opening of the weak weld 15 and 45 as well as a lowering of the opening threshold of these weak welds 15 and 45, which is of particular interest in cases of limited pressure from small-sized pistons in the machine that is mixing the contents of the pouches 11 and 41 of the capsules 1 and 4.

In these inward-pointing angular recesses 13 and 43, the liquid support area of the pouches 11 and 41, when these pouches are being subjected to vertical pressure, is closer to the center of the force exerted by this vertical pressure, which has the following two advantages in particular: the threshold necessary to "break" the weak weld 15 or 45 is lower, and there is better control over the opening of the weak weld 15 or 45 because the force from the pressure is exerted there first.

Fine-tuned control over the opening of the weak weld 15 or 45, at its inward-pointing angular recess 13 or 43, is achieved by varying the parameters of this inward-pointing angular recess 13 or 43, which in particular are the recess depth p and the length of the perimeter of the inward-pointing angular recess 13 or 43 fine-tuning the difference between the minimum force and maximum force for opening the weak weld 15 or 45 at this inward-pointing angular recess 13 or 43, the weld thickness which fine-tunes the offset, in other words the mean value around which the previous offset is positioned, this weld thickness corresponding to the outermost layers of the sheets 2 and 3 (or 5 and 6) that are welded together, this thickness being between 5 and 15 μm, advantageously about 10 μm, as well as the shape of the inward-pointing angular recess 13 or 43 which is less important than the above dimensions.

The inner weld or weak weld 15 or 45 has a weak weld periphery which is limited to extending around the pouch 11 or 41 instead of extending around the entire capsule 1 or 4. As this weak weld 15 or 45 has a reduced perimeter and a simpler form (circular and not forming an 8), the opening of this weak weld 15 or 45 can thus be better controlled because the force of the pressure is exerted on a more limited area, which better distributes the force.

Figure 10:
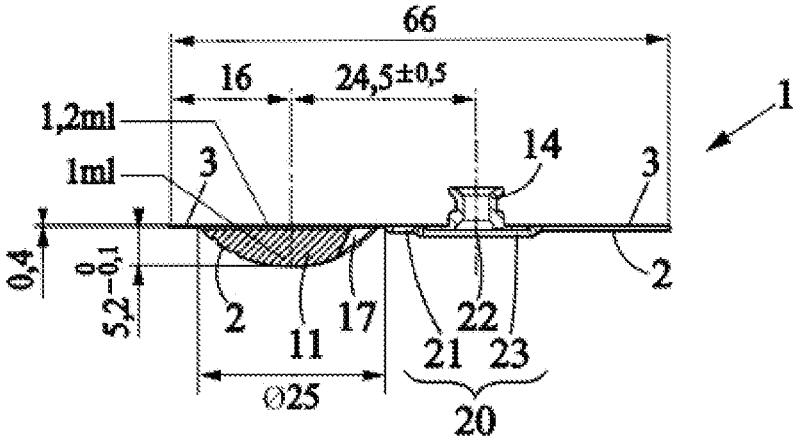
FIG. 10 represents a more precise side view, in a first direction D, of an example of a deformable capsule with a female connector according to an embodiment of the invention already represented in FIG. 9.

FIG. 10 represents a more precise side view, in a first direction D, of an example of a deformable capsule with a female connector according to an embodiment of the invention already represented in FIG. 9. The two indicated volumes, respectively 1.2 ml and 1 ml, correspond to the capacity of the deformable capsule, respectively to the maximum capacity and to the effective fill volume of the deformable capsule (ml=milliliter).

The axis of the female connector 14 is orthogonal to the mid-plane 10 of the capsule 1. The female connector 14 is completely hollow; a cosmetic product can therefore travel completely through it.

The opening of the weak weld 15 or 45 by peeling apart two films 2 and 3 (or 5 and 6) pressed against one another and fixed to one another by fusion of only their outer layers which are very thin, instead of a conventional pre-cut that tears apart, allows the opening of the frangible weld 15 or 45 to be well-controlled, due to the separation of the previously joined films 2 and 3 (or 5 and 6), and to be clean, avoiding accidental tears or small particles, this being even more attractive when the number of multiple back and forth movements between the capsules 1 and 4 of the mixture to be homogenized increases.

The extension of the channel 20 or 50 towards the pouch 11 or 41 so that the end of the inner portion 21 or 51 of the channel 20 or 50 "enters" the inward-pointing angular recess 13 or 43 of the weak weld 15 or 45, instead of stopping well before, causes a reduction of the buffer zone located between the pouch 11 or 41 and the channel 20 or 50, thus allowing better fluidity in the movement between the pouches 11 and 41 through the entire channel (including the channels 20 and 50 as well as the connectors 14 and 44), and in particular an almost direct passage from the pouch 11 or 41 to the channel 20 or 50, therefore virtually without any "dead zone" where the mixture could otherwise remain slightly stagnant, which, in fact, by backwash further improves the quality of the emulsion of the cosmetic mixture to be homogenized.

The duplication of the V-shaped inward-pointing angular recess 13 or 43, by the concavity 17 or 47 of the pouch 11 or 41, instead of having perfectly circular pouches 11 and 41, allows the shape of this pouch 11 or 41 to follow the contour of the inward-pointing angular recess 13 or 43 of the weak weld 15 or 45 in fairly close proximity, thus further improving the "peelability" effect (peelability=being more or less peelable) during the opening of this frangible wall 13 or 43.

Figure 11:
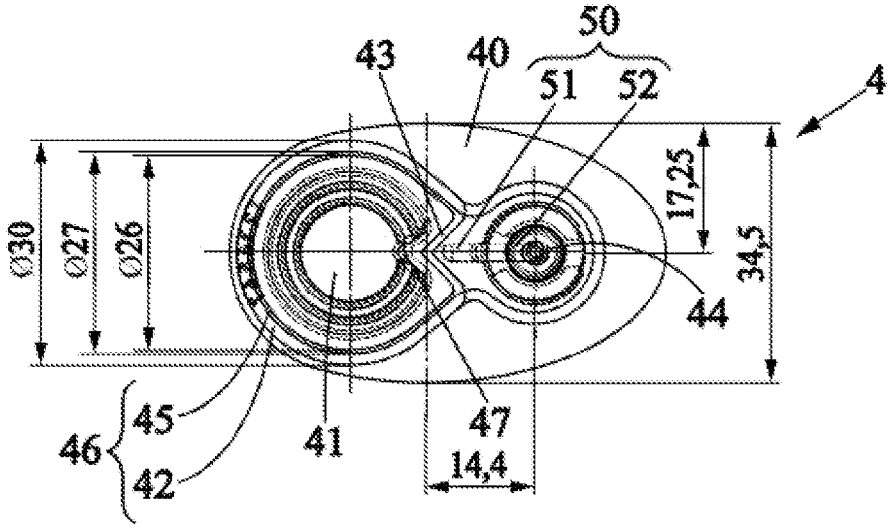
FIG. 11 represents a more precise bottom view of an example of a deformable capsule with a male connector according to an embodiment of the invention.

FIG. 11 represents a more precise bottom view of an example of a deformable capsule with a male connector according to an embodiment of the invention.

The structure of the thermoformed shell of the pouch 41 is created in a multilevel manner. The inner portion 51 of the channel 50 penetrates pronouncedly into the V formed by the inward-pointing angular recess 43. The inward-pointing angular recess 43 penetrates the concavity 47 of the pouch 41. The channel 50 maintains a constant width and cross-sectional area along its two parts: successively along its inner portion 51 and its central portion 52.

Capsule 4 behaves similarly to capsule 1.

Figure 12:
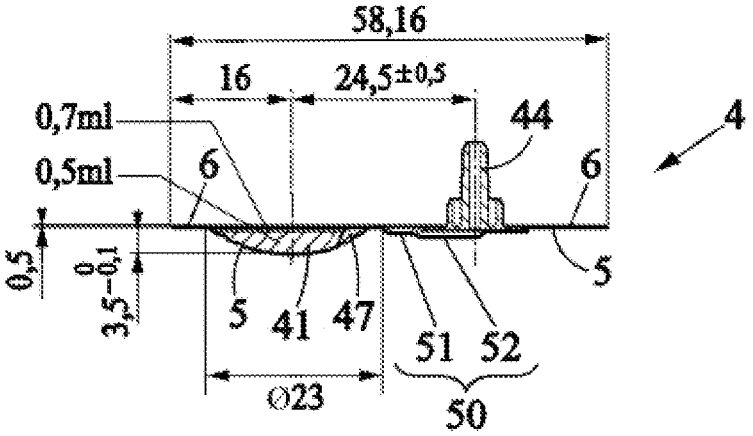
FIG. 12 schematically represents a side view, in a first direction A, of an example of a deformable capsule with a male connector according to an embodiment of the invention already represented in FIG. 11.

FIG. 12 schematically represents a side view, in a first direction A, of an example of a deformable capsule with a male connector according to an embodiment of the invention already represented in FIG. 11. The two indicated volumes, respectively 0.7 ml and 0.5 ml, correspond to the capacity of the deformable capsule, respectively to the maximum capacity and to the effective fill volume of the deformable capsule.

The axis of the male connector 44 is orthogonal to the mid-plane 40 of the capsule 4. The male connector 44 is completely hollow; a cosmetic product can therefore travel completely through it. When the male connector 44 has completely penetrated inside the female connector 14, the mixture of the cosmetic products initially contained in the pouches 11 and 41 of the capsules 1 and 4 now coupled together will be able to circulate between the pouches 11 and 41 while passing each time through the hollow interior of the male connector 44 located inside the hollow interior of the female connector 14.

Capsule 4 behaves similarly to capsule 1.

The operation of the mixer takes place with the two capsules 1 and 4 being interconnected by an autonomous machine actuating the pistons onto them, first to open the frangible welds 13 and 43 in order to release their contents initially present in the pouches 11 and 41, then to push these contents toward the other capsule, and finally to mix from one of the capsules 1 and 4 to the other of these capsules 1 and 4 and vice versa, in an alternating manner. The force to open the frangible welds 13 and 43 is controlled, so that they are able to be opened reliably in a fairly precise and repeatable manner. In a complementary manner, these frangible welds 13 and 43 are designed to withstand a minimum safety pressure before their use in the mixer. These frangible welds 13 and 43 are sealed to protect their contents from contamination or undesired opening. Such can occur due to unexpected pressure when handling during manufacture of the capsule or during transport or during placement in the mixer.

The shape and dimensional parameters of the capsules 1 and 4 proposed in relation to FIGS. 1 to 8, and in the example shown in FIGS. 9 to 12 in particular, make it possible to control the minimum and maximum opening pressures within a relatively limited range and with a reliable rate of repeatability during the production of each of these capsules 1 and 4, while ensuring the compatibility of this range with the capacity of a mixing machine for the general public and therefore relatively light, so as to be able to open these frangible welds 13 and 43 by simple actuation of its pistons upon the first movements thereof.

Of course, the present invention is not limited to the examples and to the embodiment described and represented, but is capable of numerous variants accessible to those skilled in the art.

The invention claimed is:

1. Disposable deformable capsule comprising:
- a pouch (11, 41):
  - containing a cosmetic product,
  - of which the periphery (16, 46) is formed by two sheets (2 and 3, 5 and 6) pressed against and fixed to one another,
- a channel (20, 50):
  - connecting the pouch (11, 41) to the outside of the capsule (1, 4),
  - forming a section of narrower cross-sectional area relative to the pouch (1, 4),
- a frangible wall (13, 43):
  - separating the pouch (11, 41) from the channel (20, 50),
  - having the shape of an inward-pointing angular recess (13, 43) within the otherwise convex shape of the periphery (16, 46) of the pouch (11, 41),
  - a rupture of which,
    - caused by pressure exerted on the pouch (11, 41),
    - occurs by a peeling apart, at this inward-pointing angular recess (13, 43), of these two sheets (2 and 3, 5 and 6) pressed against and fixed to one another,
    - places the pouch (11, 41) in communication with the channel (20, 50) such that the cosmetic product flows from the pouch (11, 41) to the channel (20, 50),
- a connector (14, 44):
  - male (44) or female (14), intended to couple with a connector, female (14) or male (44), of another capsule (1, 4),
  - sufficiently rigid to ensure a sealed connection between the capsules (1, 4) once the connectors (14, 44) are coupled to each other,
  - located at one end (52) of the channel (50), opposite to an end (51) of the channel (50) located next to pouch (41) or located at an opening (22) of the channel (20) that is distinct from the end (21) of the channel (20) located next to pouch (11),
  - opening to outside the capsule (1).

2. The disposable deformable capsule according to claim 1, wherein:
- the channel (20, 50) is a guide channel:
  - forming a narrowing of constant or nearly constant cross-sectional area within plus or minus 20% for all or part of a length of the channel, relative to the pouch (11, 41),
  - this narrowing of constant or nearly constant cross-sectional area having a length at least 3 times greater than the cross-sectional area's largest width,
  - the largest width of this narrowing of constant or nearly constant cross-sectional area being at least 4 times smaller than the largest width of the pouch (11, 41.

3. The disposable deformable capsule according to claim 1, wherein the periphery (16, 46) of the pouch (11, 41) is formed by two sheets (2 and 3, 5 and 6) welded to one another.

4. The disposable deformable capsule according to claim 3, wherein, as the rupture of the frangible wall (13, 43) occurs by the peeling apart, at the inward-pointing angular recess, of these two sheets (2 and 3, 5 and 6) welded to one another, this weld (15, 45) is created by fusing only the two outermost layers of the two sheets (2 and 3, 5 and 6).

5. The deformable disposable capsule according to claim 3, wherein:

the weld (15, 45) has:

a welding temperature comprised between 160° C. and 200° C., and/or a welding pressure comprised between 2 bar and 6 bar, and/or a welding time comprised between 0.5 s and 3 s.

6. The deformable disposable capsule according to claim 1, further comprising:

two welds (12 and 15, 42 and 45):

a first weld (12, 42) extending all around the pouch (11, 41) while enclosing most of the channel (20, 50), a second weld (15, 45) extending all around the pouch (11, 41) without enclosing most of the channel (20, 50), the second weld (15, 45) being at least partly arranged inside the first weld (12, 42), the second weld (15, 45) being more fragile than the first weld (12, 42), the inward-pointing angular recess (13, 43) being established by the second weld (15, 45) only and not by the first weld (12, 42).

7. The disposable deformable capsule according to claim 6, wherein the second weld (15, 45) is more fragile than the first weld (12, 42), the threshold for the pressure that will open the second weld (15, 45) being between 20% and 50% of the threshold for the pressure causing the rupture of the first weld (12, 42).

8. The disposable deformable capsule according to claim 1, wherein the shape of the pouch (11, 41) of the capsule (1, 4), in the pouch's mid-plane (10) perpendicular to the direction of the pouch's thickness, is circular.

9. The disposable deformable capsule according to claim 1, wherein:

the pouch (11, 41) is flattened, one (3, 6) of the pouch's two faces being flat, the other (2, 5) of the two faces being at least partly convex and flexible so as to allow expulsion of the contents of the pouch (11, 41) by mechanical pressure on the pouch.

10. The disposable deformable capsule according to claim 9, wherein the convex face (2, 5) is a thermoformed film.

11. The disposable deformable capsule according to claim 9, wherein the flat face (3, 6) is a flat and flexible film.

12. The disposable deformable capsule according to claim 1, wherein the convex shape (2, 5) also comprises a re-entrant portion (17, 47) into which the inward-pointing angular recess (13, 43) advances.

13. The disposable deformable capsule according to claim 1, wherein the pouch (11, 41) contains a predetermined amount of only one of the two phases, the mixture thereof forming a ready-to-use cosmetic product.

14. The disposable deformable capsule according to claim 1, wherein the inward-pointing angular recess (13, 43) has a depth (p) which is greater than half the width (l) of this angular recess (13, 43) and less than the width (l) of this angular recess (13, 43).

15. The disposable deformable capsule according to claim 1, wherein the width (lpf) of the frangible wall of the inward-pointing angular recess (13, 43) is constant along the entire length of the frangible wall of the inward-pointing angular recess (13, 43).

16. The disposable deformable capsule according to claim 1, wherein the width (lpf) of the frangible wall of the inward-pointing angular recess (13, 43) is greater at the most advanced portion of the inward-pointing angular recess (13, 43) than at the arms of the inward-pointing angular recess (13, 43).

17. The disposable deformable capsule according to claim 1, wherein the width (lpf) of the frangible wall of the inward-pointing angular recess (13, 43) is between 1 mm and 2.5 mm.

18. The disposable deformable capsule according to claim 1, wherein the inward-pointing angular recess (13, 43) has a pointed shape with the point towards the interior of the pouch.

19. The disposable deformable capsule according to claim 1, wherein the frangible wall (13, 43) is dimensioned in thickness, width, length, and shape so that the frangible wall opens when the pressure exerted on the pouch (11, 41) corresponds to a force comprised between 10 N and 45 N.

20. The disposable deformable capsule according to claim 1, wherein the periphery (16, 46) of the pouch (11, 41) is formed by two sheets (2 and 3, 5 and 6) welded to one another.

* * * * *